US008721291B2

(12) United States Patent
Lee et al.

(10) Patent No.: US 8,721,291 B2
(45) Date of Patent: May 13, 2014

(54) FLOW DIRECTING MEMBER FOR GAS TURBINE ENGINE

(75) Inventors: Ching-Pang Lee, Cincinnati, OH (US); Kok-Mun Tham, Orlando, FL (US); Paul H. Vitt, Liberty Township, OH (US); Stephen R. Williamson, Cincinnati, OH (US); Matthew D. Montgomery, Jupiter, FL (US); Chander Prakash, Orlando, FL (US); Melissa Harris, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 440 days.

(21) Appl. No.: 13/180,578

(22) Filed: Jul. 12, 2011

(65) Prior Publication Data

US 2013/0017095 A1 Jan. 17, 2013

(51) Int. Cl.
*F01D 5/14* (2006.01)

(52) U.S. Cl.
USPC ..... 416/193 A

(58) Field of Classification Search
USPC ..... 415/199.5, 220, 227, 228; 416/193 A
See application file for complete search history.

(56) References Cited

U.S. PATENT DOCUMENTS

| | | | | |
|---|---|---|---|---|
| 2,656,147 | A * | 10/1953 | Denison et al. | 416/97 R |
| 5,947,687 | A * | 9/1999 | Mori et al. | 416/193 A |
| 6,077,035 | A | 6/2000 | Walters et al. | |
| 6,283,713 | B1 | 9/2001 | Harvey et al. | |
| 6,478,545 | B2 | 11/2002 | Crall et al. | |
| 6,511,294 | B1 | 1/2003 | Mielke et al. | |
| 6,669,445 | B2 | 12/2003 | Staubach et al. | |
| 7,134,842 | B2 * | 11/2006 | Tam et al. | 416/193 A |
| 7,189,055 | B2 | 3/2007 | Marini et al. | |
| 7,220,100 | B2 | 5/2007 | Lee et al. | |
| 7,244,104 | B2 | 7/2007 | Girgis et al. | |
| 7,484,936 | B2 * | 2/2009 | Bouchard et al. | 416/193 R |
| 7,762,773 | B2 | 7/2010 | Liang | |
| 8,083,475 | B2 * | 12/2011 | Bulgrin et al. | 415/173.7 |
| 2009/0297351 | A1 * | 12/2009 | Brahmasuraih | 416/219 R |
| 2010/0143139 | A1 | 6/2010 | Pandey et al. | |
| 2010/0158696 | A1 | 6/2010 | Pandey et al. | |
| 2011/0014056 | A1 | 1/2011 | Guimbard et al. | |

FOREIGN PATENT DOCUMENTS

JP 2004-036510 A * 2/2004

OTHER PUBLICATIONS

Koichiro, Moving Blade Shroud for Gas Turbine, Feb. 5, 2004, Abstract of JP2004-036510A.*

* cited by examiner

*Primary Examiner* — Edward Look
*Assistant Examiner* — Liam McDowell

(57) ABSTRACT

In a gas turbine engine, a flow directing member includes a platform supported on a rotor and includes a radially facing endwall and at least one axially facing axial surface extending radially inwardly from a junction with the endwall. The flow directing member further includes an airfoil extending radially outwardly from the endwall and a fluid flow directing feature. The fluid flow directing feature includes a groove extending axially into the axial surface. The groove has a radially inner groove end and a radially outer groove end, wherein the outer groove end defines an axially extending notch in the junction between the axial surface and the endwall and forms an opening in the endwall for directing a cooling fluid to the endwall.

18 Claims, 6 Drawing Sheets

FLOW DIRECTING MEMBER FOR GAS TURBINE ENGINE

FIELD OF THE INVENTION

The present invention relates generally to gas turbine engines and, more particularly, to flow directing members associated with rotating blades in gas turbine engines.

BACKGROUND OF THE INVENTION

A gas turbine engine typically includes a compressor section, a combustor, and a turbine section. The compressor section compresses ambient air that enters an inlet. The combustor combines the compressed air with a fuel and ignites the mixture creating combustion products defining a working fluid. The working fluid travels to the turbine section where it is expanded to produce a work output. Within the turbine section are rows of stationary flow directing members comprising vanes directing the working fluid to rows of rotating flow directing members comprising blades coupled to a rotor. Each pair of a row of vanes and a row of blades forms a stage in the turbine section.

Advanced gas turbines with high performance requirements attempt to reduce the aerodynamic losses as much as possible in the turbine section. This in turn results in improvement of the overall thermal efficiency and power output of the engine. Further, it is desirable to reduce hot gas ingestion from a hot gas path into cooled air cavities in the turbine section. Such a reduction of hot gas ingestion results in a smaller cooling air requirement in the cavities, which yields a smaller amount of cooling fluid leakage into the hot gas path, thus further improving the overall thermal efficiency and power output of the engine.

SUMMARY OF THE INVENTION

In accordance with one aspect, a flow directing member is provided for a gas turbine engine. The flow directing member includes a platform supported on a rotor and comprises a radially facing endwall and at least one axially facing axial surface extending radially inwardly from a junction with the endwall. The flow directing member further includes an airfoil extending radially outwardly from the endwall and a fluid flow directing feature. The fluid flow directing feature comprises a groove extending axially into the axial surface. The groove includes a radially inner groove end and a radially outer groove end, wherein the outer groove end defines an axially extending notch in the junction between the axial surface and the endwall and forms an opening in the endwall for directing a cooling fluid to the endwall.

In accordance with another aspect, a flow directing member is provided for a gas turbine engine. The flow directing member includes a platform supported on a rotor and comprises a radially facing endwall, a forward axial surface facing axially forwardly toward an oncoming flow of a working gas and extending radially inwardly from a forward junction with the endwall, and a rearward axial surface facing axially rearwardly in a downstream direction of the working gas and extending radially inwardly from a rearward junction with the endwall. The flow directing member further includes an airfoil extending radially outwardly from the endwall. The flow directing member further comprises a first groove defining a first fluid flow directing feature. The first groove extends axially into the forward axial surface and effects a directing of cooling fluid from a first cooling fluid cavity associated with the flow directing member. The flow directing member further comprises a second groove defining a second fluid flow directing feature. The second groove extends axially into the rearward axial surface and effects a directing of cooling fluid from a second cooling fluid cavity associated with the flow directing member. The flow directing member further comprises at least one contour on the endwall. The at least one contour comprises at least one of: at least one peak adjacent to a leading edge of the airfoil and extending along at least a portion of the endwall adjacent to a suction side of the airfoil; and at least one valley located along at least a portion of the endwall adjacent to a pressure side of the airfoil.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
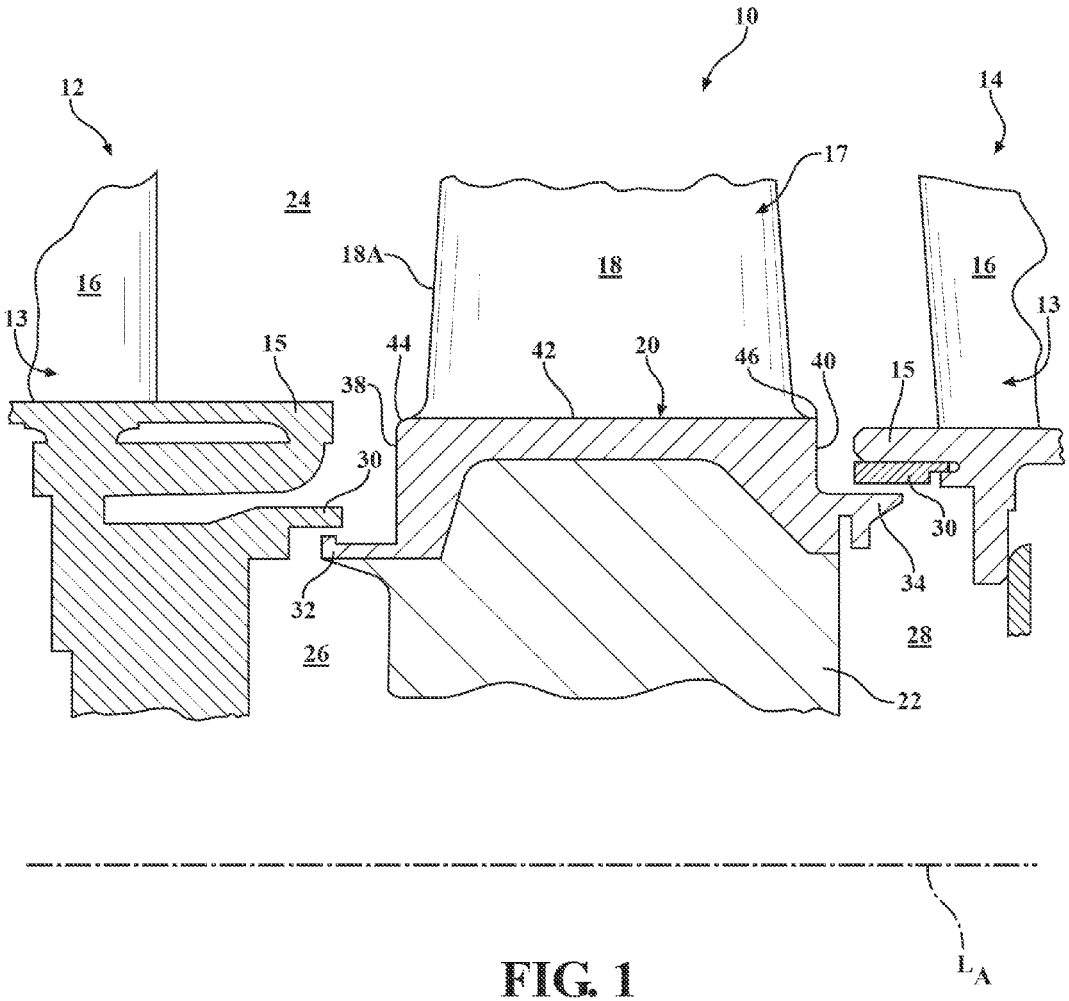
FIG. 1 is a cross-sectional view of a portion of a turbine section in a gas turbine engine formed in accordance with aspects of the invention.

Referring to FIG. 1, a portion of a turbine engine 10 is illustrated diagrammatically including adjoining stages 12, 14, each stage comprising an array of stationary flow directing members 13 comprising stationary airfoils, i.e., vanes 16, suspended from an outer casing (not shown) and affixed to an annular inner shroud 15. Each stage further comprises an array of rotating flow directing members 17 comprising rotating airfoils, i.e., blades 18, supported on respective platforms 20. The platforms 20 of the flow directing members 17 are supported on and effect rotation of a rotor, a portion of which is formed by rotor disk 22, which rotor is conventional and will not be described in detail herein. As used herein, the term "platform" may refer to any structure associated with the rotating flow directing members 17 that is located between and rotates with the blades 18 and the rotor during operation of the engine 10, such as, for example, roots, side plates, shanks, etc.

The vanes 16 and the blades 18 are positioned circumferentially within the engine 10 with alternating rows of vanes 16 and blades 18 located in an axial direction defining a longitudinal axis $L_A$ of the engine 10, see FIG. 1. The vanes 16 and blades 18 extend into an annular hot gas path 24 through which a working gas comprising hot combustion gases is directed. The working gas flows through the hot gas path 24 through the rows of vanes 16 and the blades 18 during operation of the engine 10 and causes rotation of the blades 18 and corresponding platforms 20 to provide rotation of the rotor.

Structure of one of the rotating flow directing members 17 will now be described, it being understood that the other rotating flow directing members 17 in the engine 10 may be substantially similar to the one described.

As shown in FIG. 1, first and second cooling fluid cavities 26, 28 are associated with the platform 20 of the flow directing member 17 and are located radially inwardly from the hot gas path 24 on respective sides of the platform 20. A cooling fluid, e.g., compressor discharge air, is provided to the cavities 26, 28 to cool the platform 20 and the adjacent annular inner shrouds 15. The cooling fluid also provides a pressure balance against the pressure of the working gas flowing in the hot gas path 24 to counteract a flow of the working gas into the cavities 26, 28. It is noted that the first and second cooling fluid cavities 26, 28 need not be mutually exclusive, i.e., they could be in fluid communication with one another.

Interstage seals 30, such as, for example, labyrinth seals, knife edge seals, honeycomb seals, etc., may be supported at radially inner sides of the annular inner shrouds 15 and may cooperate with first and second angel wing seal members 32, 34 that extend axially from opposed first and second axially facing axial surfaces of the platform 20 to reduce or limit leakage from the hot gas path 24 into the cavities 26, 28. In the embodiment shown, the first axially facing axial surface comprises a forward axial surface 38 that faces axially forwardly toward an oncoming flow of the working gas passing through the hot gas path 24, and the second axially facing axial surface comprises a rearward axial surface 40 facing axially rearwardly in a downstream direction of the working gas. The forward and rearward axial surfaces 38, 40 each may be defined by a radially extending plane extending between circumferentially spaced matefaces of the platform 20, which matefaces will be described below.

The rotating flow directing member 17 comprises one or more fluid flow directing features, which will now be described. It is noted that, the flow directing member 17 preferably comprises a plurality of fluid flow directing features, although additional or fewer fluid flow directing features may be provided.

The platform 20 comprises the forward and rearward axial surfaces 38, 40 and an endwall 42 that faces radially outwardly toward the hot gas path 24 and defines a radially inner boundary for the hot gas path 24. In the embodiment shown, the endwall 42 is generally perpendicular to each of the axial surfaces 38, 40, which extend radially inwardly from respective forward and rearward junctions 44, 46 with the endwall 42, see FIG. 1. As shown in FIGS. 2-5, the platform 20 further comprises upstream and downstream matefaces 48A, 48B that form mateface gaps 49 with matefaces 48A, 48B of adjacent platforms 20, the terms "upstream" and "downstream" being defined with reference to a direction of rotation $D_R$ of the rotor. In particular, the mateface gaps 49 are formed by opposing matefaces 48A, 48B of adjacent platforms 20 extending from the forward axial surface 38 of each of platform 20 to the rearward axial surface 40 of each of platform 20. The opposing matefaces 48A, 48B in the embodiment shown extend substantially parallel to each other in the radial direction, generally perpendicular to the endwall 42 of each platform 20.

Figure 2:
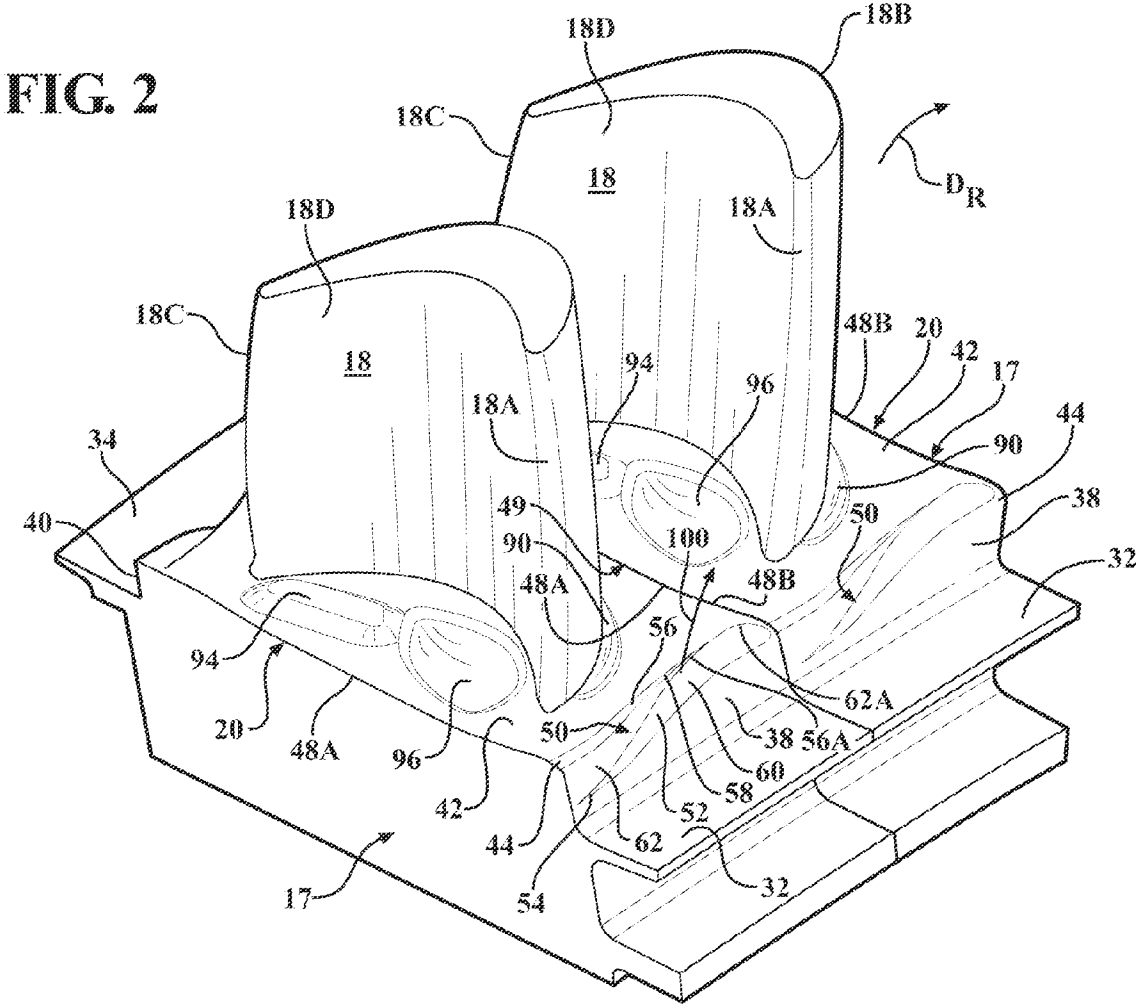
FIGS. 2 and 3 are perspective views of forward faces of adjacent flow directing members formed in accordance with aspects of the invention.
Figure 3:
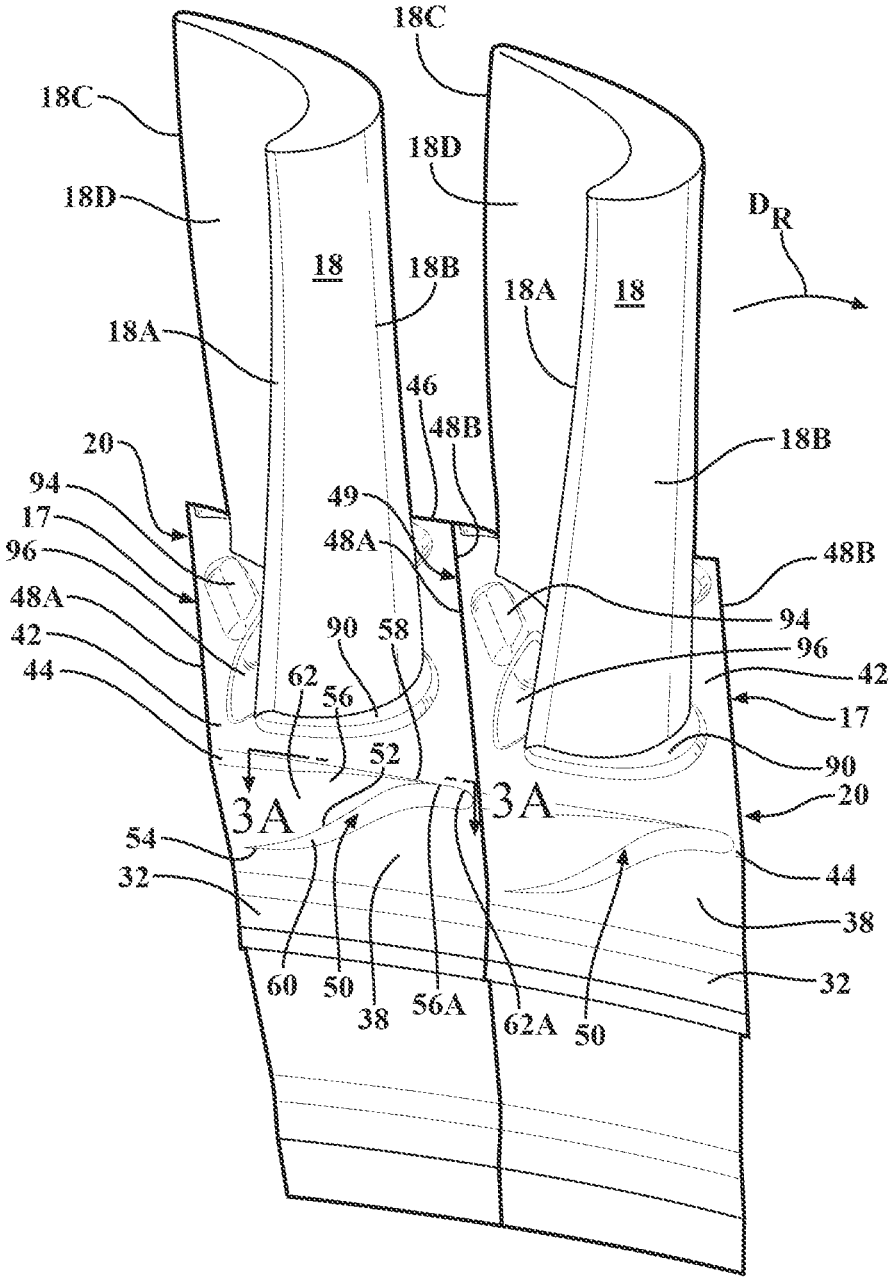

Referring to FIGS. 2-3, the forward axial surface 38 comprises a first fluid flow directing feature 50. The first fluid flow directing feature 50 comprises a first groove 52, also referred to as a forward groove, extending axially into the forward axial surface 38. The first groove 52 effects a flow directing of cooling fluid from the first cooling fluid cavity 26, as will be described below. In the embodiment shown, the first fluid flow directing feature 50 comprises one first groove 52 per blade 18 that is provided on the platform 20, i.e., if the platform 20 comprises multiple blades 18, a corresponding number of first grooves 52 may be provided in the platform 20. Further, the first groove 52 extends a substantial circumferential length of the platform 20, e.g., more than about one quarter of the circumferential length of the platform 20, and preferably at least about one half or more of the circumferential length of the platform 20. It is noted that if the platform 20 comprises multiple blades 18, the first groove 52 may extend a lesser circumferential extent of the platform 20 than one quarter of the platform 20, e.g., the first groove 52 may have a circumferential length about the same as a circumferential footprint of one of the blades 18 on the platform 20, i.e., a distance measured in the direction of rotation $D_R$ and generally extending from a circumferential location of a leading edge 18A of the blade 18 to an apex of a curved suction side 18B of the blade 18.

The first groove 52 includes a radially inner groove end 54 and a radially outer groove end 56 that is spaced in the radial direction from the inner groove end 54, see FIGS. 2 and 3. The inner groove end 54 is located between the first angel wing seal member 32 and the forward junction 44 and is preferably located in close proximity to the first angel wing seal member 32. The inner groove end 54 according to this embodiment of the invention is located at a circumferential location that is generally aligned with the leading edge 18A of the blade 18 but may be located at other circumferential locations.

As shown most clearly in FIG. 2, the outer groove end 56 defines an axially extending notch 58 in the forward junction 44 and forms an opening in the endwall 42 for directing cooling fluid from the first cooling fluid cavity 26 to the endwall 42, as will be described below. In the embodiment shown, the outer groove end 56 is located at a circumferential location that spans a substantial circumferential length of the platform 20 and includes a portion 56A that is offset from the circumferential location of the inner groove end 54. The portion 56A is located in close proximity to the mateface gap 49 associated with the downstream mateface 48B of the platform 20 but may be located at other circumferential locations.

Figure 3A:
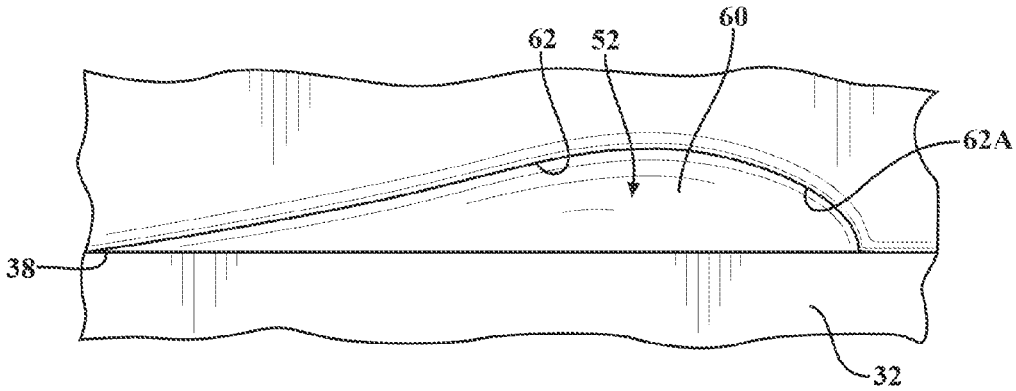
FIG. 3A is a plan view looking in a radially inward direction from line 3A-3A in FIG. 3.

According to this embodiment, the first groove 52 is defined by opposing first and second axially and radially extending groove walls 60, 62, wherein the second groove wall 62 in the embodiment shown is generally perpendicular to the first groove wall 60, see FIGS. 2-3 and 3A although the angle between the groove walls 60, 62 may be greater or less than perpendicular. The first and second groove walls 60, 62 each commence at the inner groove end 54 and extend to the outer groove end 56.

The first groove wall 60 in the embodiment shown comprises a concave to convex wall with respect to a radial direction and generally defines an S-shape when viewed in the axial direction. The first groove wall 60 gradually extends further axially into the forward axial surface 38 as it extends from the inner groove end 54 toward the outer groove end 56, see FIG. 3A, i.e., an axial depth of the first groove wall 60 measured at the inner groove end 54 is less than an axial depth of the first groove wall 60 toward the outer groove end 56.

The second groove wall 62 in the embodiment shown comprises a concave wall with respect to a circumferential direction and extends from the first groove wall 60 to the outer groove end 56. The second groove wall 62 gradually extends further axially into the forward axial surface 38 as it extends in the direction of rotation $D_R$ of the rotor, i.e., an axial depth of the second groove wall 62 measured at an upstream location is less than an axial depth of the second groove wall 62 at a downstream location. However, a circumferential end portion 62A of the second groove wall 62 extends axially outwardly to define a smooth, curved end portion 62A, as shown most clearly in FIG. 3A.

It is noted that the invention is not intended to be limited to first grooves 52 having the configuration shown in FIGS. 2-3 and 3A, i.e., first grooves having different configurations are contemplated.

Figure 5A:
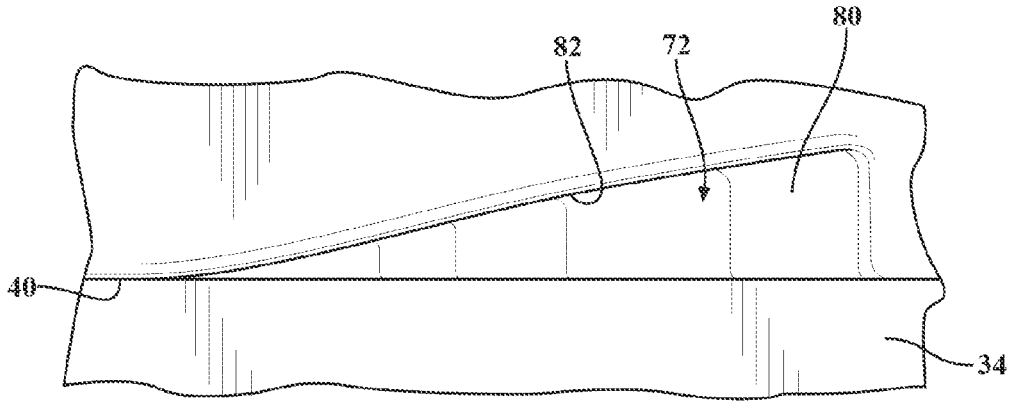
FIG. 5A is a plan view looking in a radially inward direction from line 5A-5A in FIG. 5.
Figure 4:
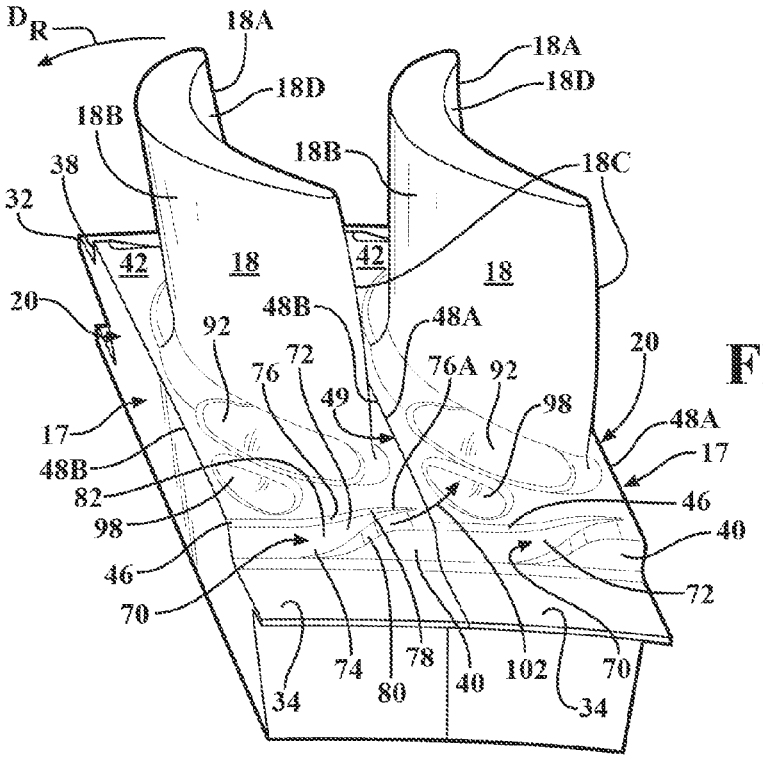
FIGS. 4 and 5 are perspective views of rearward faces of the flow directing members illustrated in FIGS. 2 and 3.
Figure 5:
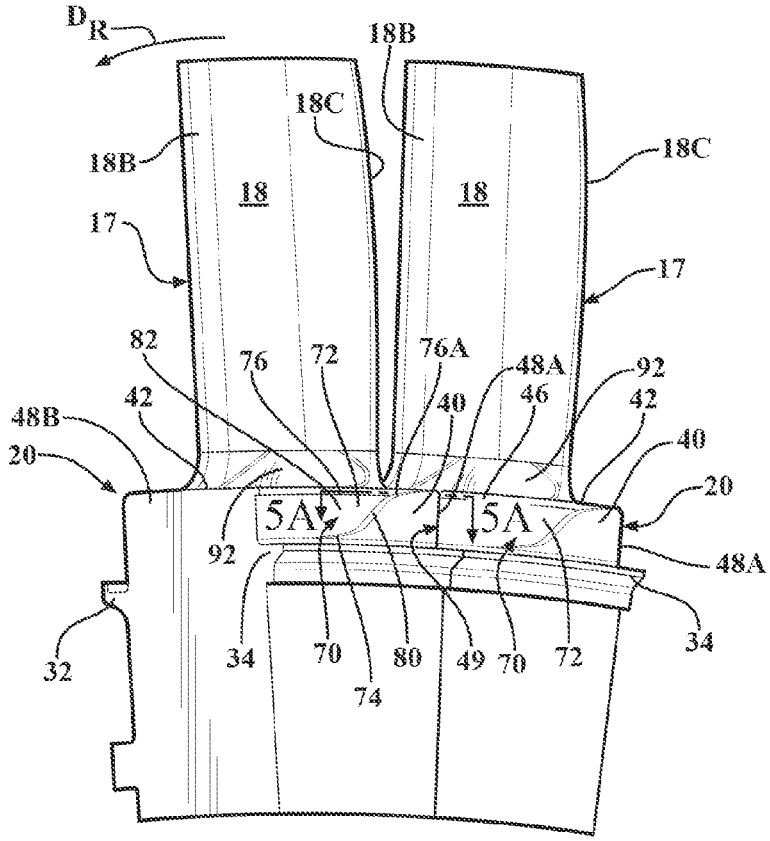

Referring now to FIGS. 4 and 5, the rearward axial surface 40 comprises a second fluid flow directing feature 70. The second fluid flow directing feature 70 comprises a second groove 72, also referred to as a rearward groove, extending axially into the rearward axial surface 40. The second groove 72 effects a pumping and flow directing of cooling fluid from the second cooling fluid cavity 28, as will be described below. In the embodiment shown, the second fluid flow directing feature 70 comprises one second groove 72 per blade 18 that is provided on the platform 20, i.e., if the platform 20 comprises multiple blades 18, a corresponding number of second grooves 72 may be provided in the platform 20. Further, the second groove 72 extends a substantial circumferential length of the platform 20, e.g., more than about one quarter of the circumferential length of the platform 20, and preferably at least about one half or more of the circumferential length of the platform 20. It is noted that if the platform 20 comprises multiple blades 18, the second groove 72 may extend a lesser circumferential extent of the platform 20 than one quarter of the platform 20, e.g., the second groove 72 may have a circumferential length about the same as a circumferential footprint of one of the blades 18 on the platform 20, i.e., a distance measured in the direction of rotation $D_R$ and generally extending from the circumferential location of the leading edge 18A of the blade 18 to the apex of the curved suction side 18B of the blade 18.

The second groove 72 includes a radially inner groove end 74 and a radially outer groove end 76 that is spaced in the radial direction from the inner groove end 54, see FIGS. 4 and 5. The inner groove end 74 is located between the second angel wing seal member 34 and the rearward junction 46 and is preferably located in close proximity to the second angel wing seal member 34. The inner groove end 74 according to this embodiment of the invention is located at a circumferential location that is generally midway between the upstream and downstream matefaces 48A, 48B of the platform 20 but may be located at other circumferential locations.

As shown most clearly in FIG. 4, the outer groove end 76 defines an axially extending notch 78 in the rearward junction 46 and forms an opening in the endwall 42 for directing cooling fluid pumped from the second cooling fluid cavity 28 to the endwall 42, as will be described below. In the embodiment shown, the outer groove end 76 is located at a circumferential location that spans a substantial circumferential length of the platform 20 and includes a portion 76A that is offset from the circumferential location of the inner groove end 74. The portion 76A is located in close proximity to the mateface gap 49 associated with the upstream mateface 48A of the platform 20 but may be located at other circumferential locations.

According to this embodiment, the second groove 72 is defined by first and second axially and radially extending groove walls 80, 82, wherein the second groove wall 82 in the embodiment shown is generally perpendicular to the first groove wall 80, see FIGS. 4-5, and 5A although the angle between the groove walls 80, 82 may be greater or less than perpendicular. The first and second groove walls 80, 82 each commence at the inner groove end 74 and extend to the outer groove end 76.

The first groove wall 80 in the embodiment shown comprises a concave to convex wall with respect to the radial direction and generally defines an S-shape when viewed in the axial direction. The first groove wall 80 gradually extends further axially into the rearward axial surface 40 as it extends from the inner groove end 74 toward the outer groove end 76, see FIG. 5A, i.e., an axial depth of the first groove wall 80 measured at the inner groove end 74 is less than an axial depth of the first groove wall 80 at the outer groove end 76.

The second groove wall 82 in the embodiment shown comprises a concave wall with respect to the circumferential direction and extends from the first groove wall 80 to the outer groove end 76. The second groove wall 82 gradually extends further axially into the rearward axial surface 40 as it extends away from the direction of rotation $D_R$ of the rotor, i.e., an axial depth of the second groove wall 82 measured at an upstream location is greater than an axial depth of the second groove wall 82 at a downstream location.

It is noted that the invention is not intended to be limited to second grooves 72 having the configuration shown in FIGS. 4-5 and 5A, i.e., second grooves having different configurations are contemplated.

The endwall 42 of the platform 20 in the embodiment shown comprises a series of contours to effect a desired flow of gases over the endwall 42, as will be described herein. It is noted that additional or fewer contours than those shown in FIGS. 2-5 may be provided in the endwall 42.

Referring to FIGS. 2 and 3, the endwall 42 includes a leading edge peak 90 adjacent to the leading edge 18A of the blade 18. The leading edge peak 90 comprises a raised area of the endwall 42 and extends from the leading edge 18A of the blade 18 along a portion of the suction side 18B of the blade 18. The endwall 42 also includes a trailing edge suction side peak 92 adjacent to a trailing edge 18C of the blade 18, see FIGS. 4 and 5. The trailing edge suction side peak 92 comprises a raised area of the endwall 42 and extends along the suction side 18B of the blade 18 from about a mid-chord location of the blade 18 to the trailing edge 18C of the blade. The endwall 42 further includes a trailing edge pressure side peak 94 adjacent to the trailing edge 18C of the blade 18, see FIGS. 2 and 3. The trailing edge pressure side peak 94 comprises a raised area of the endwall 42 and extends along a pressure side 18D of the blade 18 from the trailing edge 18C of the blade toward the mid-chord location of the blade 18.

In addition to the peaks 90, 92, 94, the endwall 42 further comprises contours in the form of valleys that comprise recessed portions of the endwall 42. In the embodiment shown, the endwall 42 comprises a pressure side valley 96 located adjacent to the pressure side 18D of the blade 18 between the leading edge 18A of the blade 18 and the trailing edge pressure side peak 94, see FIGS. 2 and 3. The endwall 42 also comprises a trailing edge valley 98 located adjacent to the trailing edge suction side peak 92 and the rearward junction 46, i.e., in a region between the trailing edge 18C of the blade 18 and the mateface gap 49 associated with the downstream mateface 48B, see FIG. 4.

During operation of the engine 10, the working gas flowing through the hot gas path 24 effects rotation of the blades 18, platforms 20, and the rotor, as will be apparent to those skilled in the art. While a main flow of working gas passes generally in the axial direction between adjacent airfoils, i.e., vanes 16 and blades 18, the working gas further defines flow fields adjacent to the endwalls 42 of the platforms 20 comprising streamlines, wherein at least a portion of the streamlines extend generally transverse to the axial direction, i.e., extending from one blade 18 toward an adjacent blade 18.

The endwalls 42 according to this embodiment of the invention comprise a series of contours to effect a desired flow of gases over the endwall 42. The contours may continuously or smoothly decrease in elevation from tops of the peaks 90, 92, 94, and the contours may continuously or smoothly increase in elevation from lowermost portions of the valleys 96, 98 as represented by the contour lines in FIGS. 2-5. The contoured endwalls 42 effect a reduction in secondary flow vortices, and aerodynamic losses associated with such secondary flow vortices, in the flow fields adjacent to the endwalls 42.

Moreover, cooling fluid, e.g., compressor discharge air, is pumped into the first and second cooling fluid cavities 26, 28. The cooling fluid provides cooling to the platforms 20 and the annular inner shrouds 15 and provides a pressure balance against the pressure of the working gas flowing in the hot gas path 24 to counteract a flow of the working gas into the cavities 26, 28. Further, rotation of the first and second wing seal members 32, 34, i.e., caused by rotation of the platforms 20 and the rotor, exerts a suction force on the cooling fluid in the respective cavities 26, 28. The suction force on the cooling fluid causes portions of the cooling fluid in the cavities 26, 28 to flow to the wing seal members 32, 34, which inject the portions of the cooling fluid radially outwardly.

Flow directing of the cooling fluid from the cooling fluid cavities 26, 28 to the endwalls 42 of the platforms 20 by respective ones of the first and second fluid flow directing features 50, 70 will now be described.

Referring to the first fluid flow directing feature 50, the cooling fluid injected from the first cooling fluid cavity 26 by the wing seal member 32 (hereinafter "first portion of cooling fluid") enters the forward groove 52 at the inner groove end 54 and flows radially outwardly within the forward groove 52 to the notch 58 defined by the outer groove end 56.

The outer groove end 56 discharges the first portion of cooling fluid onto the endwall 42 of the respective platform 20 in a direction toward the endwall 42 of the adjacent downstream platform 20, as indicated by the flow lines 100 illustrated in FIG. 2. That is, the first portion of cooling fluid from the forward groove 52 includes a component in a first direction that is parallel to the direction of rotation $D_R$ of the rotor so as to flow toward the endwall 42 of the adjacent downstream platform 20. Since the portion 56A of the outer groove end 56 is circumferentially located adjacent to the mateface gap 49 between the platform 20 and the platform 20 of the adjacent downstream flow directing member 17, the first portion of cooling fluid flows toward the blade 18 on the adjacent downstream platform 20, i.e., toward the leading edge 18D of the adjacent blade 18. Specifically, the first portion of cooling fluid is discharged to flow between the leading edge peaks 90 of adjacent blades 18 and toward the pressure side valley 96 of the adjacent downstream endwall 42.

The first portion of the cooling fluid provides cooling fluid to portions of each of the platform endwalls 42 where elevated temperatures may exist and may mix with the working gas flowing through the hot gas path 24. In particular, the cooling fluid may be directed to locations of the contoured endwall 42 where a characteristic of the gas flow resulting from the contours may comprise localized areas of elevated temperatures at the endwall 42. It has been observed that such local elevated temperature areas may exist at the leading edges 18A and associated pressure side valleys 96, as well as at areas adjacent to the trailing edges 18C and in particular in the region defines by the trailing edge valleys 98. Hence, the cooling fluid is specifically directed to these identified regions of elevated temperature.

Turning now to the second fluid flow directing feature 70, rotation of the rearward groove 72, i.e., resulting from rotation of the respective platform 20, exerts a radially outward force on the cooling fluid injected from the second cooling fluid cavity 28 by the wing seal member 34 (hereinafter "second portion of cooling fluid"). The second portion of cooling fluid enters the rearward groove 72 at the inner groove end 74 and flows radially outwardly within the rearward groove 72 to the notch 78 defined by the outer groove end 76.

The outer groove end 76 discharges the second portion of cooling fluid onto the endwall 42 of the respective platform 20 in a direction toward the endwall 42 of the adjacent upstream platform 20, i.e., the second portion of cooling fluid pumped out of the rearward groove 72 includes a component in a second direction opposite to the first direction so as to flow toward the endwall 42 of the adjacent upstream platform 20, as indicated by the flow lines 102 illustrated in FIG. 4. Since the portion 76A of the outer groove end 76 is circumferentially located adjacent to the mateface gap 49 between the platform 20 and the platform 20 of the adjacent upstream flow directing member 17, the second portion of cooling fluid flows toward the adjacent upstream platform 20, i.e., toward the trailing edge 18C of the adjacent blade 18. Specifically, the second portion of cooling fluid is discharged to flow toward the trailing edge valley 98 of the adjacent upstream endwall 42.

The second portion of the cooling fluid provides cooling fluid to portions of each of the platform endwalls 42 and may mix with the working gas flowing through the hot gas path 24.

In addition to providing cooling to the endwalls 42 of the platforms 20, the passage of the portions of cooling fluid through the respective grooves 52, 72 and onto the endwalls 42 of the platforms 20 may reduce or limit ingestion of the working gas in the hot gas path 24 into the first and second cooling fluid cavities 26, 28 by pushing the working gas in the hot gas path 24 away from the cavities 26, 28.

Figure 6:
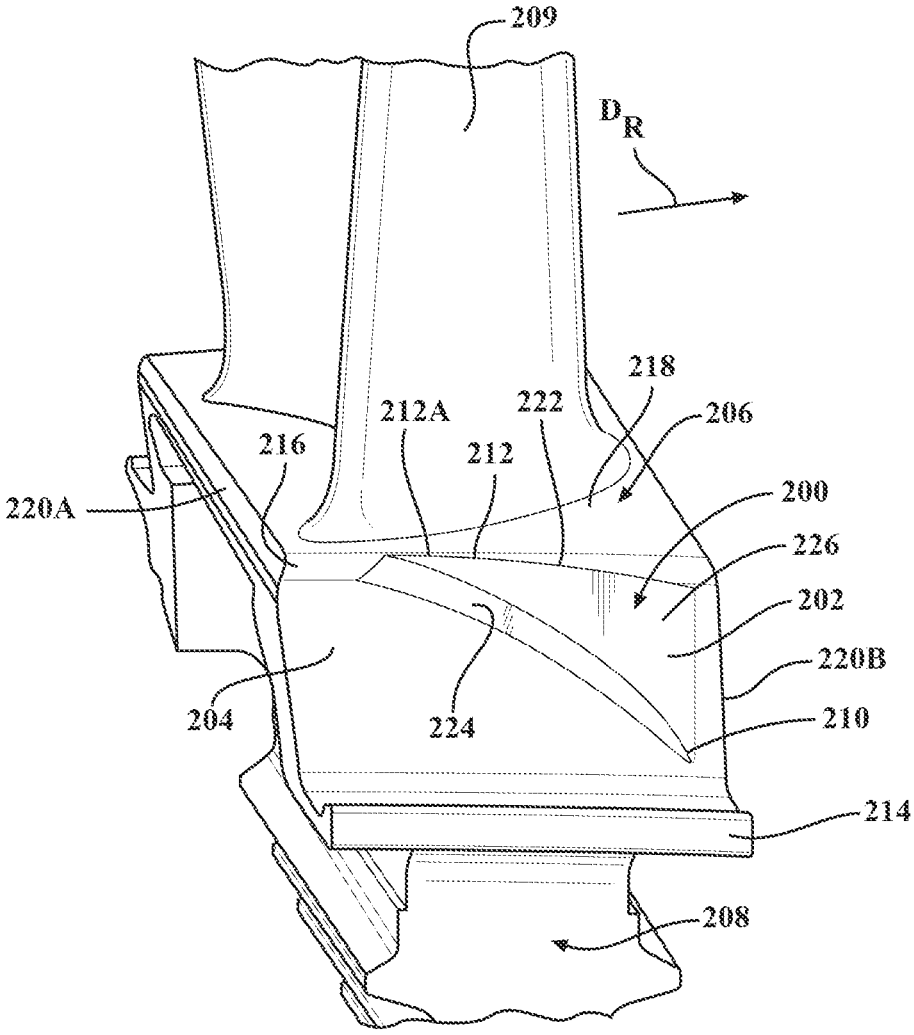
FIG. 6 is a perspective of a forward face of a flow directing member formed in accordance with further aspects of the invention.

FIG. 6 illustrates a fluid flow directing feature 200 according to another embodiment as a modification of the fluid flow directing feature 50 illustrated in FIGS. 2-3. The fluid flow directing feature 200 comprises a groove 202 extending axially into an axially facing axial surface 204 of a platform 206, such as the forward axial surface 38 described above with reference to FIGS. 1-3. The groove 202 effects a pumping of cooling fluid from a cooling fluid cavity 208. In the embodiment shown, the fluid flow directing feature 200 comprises a single groove 202 per blade 209 associated with the platform 206.

The groove 202 includes a radially inner groove end 210 and a radially outer groove end 212 that is spaced in the radial direction from the inner groove end 210. The inner groove end 210 is located between an angel wing seal member 214 and a junction 216 between the axial surface 204 and an endwall 218 of the platform 206 and is preferably located in close proximity to the angel wing seal member 214. The inner groove end 210 according to this embodiment of the invention is located at a circumferential location that is in close proximity to a mateface gap associated with a downstream mateface 220B of the platform 206 but may be located at other circumferential locations.

The outer groove end 212 defines an axially extending notch 222 in the junction 216 and forms an opening in the endwall 218 for directing cooling fluid pumped from the cooling fluid cavity 208 to the endwall 218. In the embodiment shown, the outer groove end 212 includes a portion 212A that is offset from the circumferential location of the inner groove end 210 and is located in close proximity to a mateface gap associated with an upstream mateface 220A of the platform 206 but may be located at other circumferential locations.

According to this embodiment, the groove 202 is defined by opposing first and second axially and radially extending groove walls 224, 226, wherein the second groove wall 226 in the embodiment shown is generally perpendicular to the first groove wall 224 although the angle between the groove walls 224, 226 may be greater or less than perpendicular. The first and second groove walls 224, 226 each commence at the inner groove end 210 and extend to the outer groove end 212.

The first groove wall 224 in the embodiment shown comprises a convex wall with respect to a radial direction. The first groove wall 224 gradually extends further axially into the axial surface 204 as it extends from the inner groove end 210 toward the outer groove end 212, i.e., an axial depth of the first groove wall 224 measured at the inner groove end 210 is less than an axial depth of the first groove wall 224 toward the outer groove end 212.

The second groove wall 226 in the embodiment shown comprises a concave wall with respect to the circumferential direction but may comprise other configurations, such as a convex wall or a flat wall. The second groove wall 226 extends from the first groove wall 224 to the outer groove end 212. The second groove wall 226 gradually extends further axially into the axial surface 204 as it extends in the opposite direction as the direction of rotation $D_R$ of the rotor, i.e., an axial depth of the second groove wall 226 measured at an upstream location is greater than an axial depth of the second groove wall 226 at a downstream location.

According to this embodiment, the groove 202 is oriented in the opposite direction than the first groove 52 according to the embodiment discussed above with reference to FIGS. 1-5. That is, with reference to a direction of rotation $D_R$ of a rotor (not shown in this embodiment), the first groove 52 described above extends radially outwardly as the first groove extends in the direction of rotation $D_R$ of the rotor. The groove 202 according to this embodiment extends radially outwardly as the groove 202 extends in an opposite direction as the direction of rotation $D_R$ of the rotor.

The groove 202 according to this embodiment is preferably used in engines where the circumferential velocity component of gases passing through the turbine section, i.e., a combination of hot combustion gas with cooling fluid that is pumped from cooling fluid cavities, is slower than the rotational velocity of the rotor. In such a configuration, since the platform 206 and the groove 202 are traveling faster than the gases and due to the orientation of the groove 202, the gases are substantially prevented from entering the groove 202 and traveling radially inwardly toward the cooling fluid cavity 208. In the embodiment discussed above with reference to FIGS. 1-5, the gases may be traveling faster than the platform 20 and the first groove 52, wherein the relative velocities of the gases and the platform/first groove 20/52 in combination with the orientation of the first groove 52 substantially prevent the gases from entering the first groove 52 and traveling radially inwardly toward the first cooling fluid cavity 26.

The cooling fluid pumping features described herein can be cast integral with the platform or can be machined into the platform after casting of the platform. Further, the cooling fluid pumping features can be implemented in newly casted platforms or machined into existing platforms, e.g., in a servicing operation.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A flow directing member for a gas turbine engine, the flow directing member including a platform supported on a rotor and comprising a radially facing endwall and at least one axially facing axial surface extending radially inwardly from a junction with the endwall, the flow directing member further including an airfoil extending radially outwardly from the endwall and a fluid flow directing feature, the fluid flow directing feature comprising:

a groove extending axially into the axial surface, the groove including a radially inner groove end and a radially outer groove end; and wherein the outer groove end defines an axially extending notch in the junction between the axial surface and the endwall and forming an opening in the endwall for directing a cooling fluid to the endwall.

2. The flow directing member of claim 1, wherein the first and second groove walls are generally perpendicular to one another.

3. The flow directing member of claim 1, wherein the axial surface comprises a forward axial surface facing axially forwardly toward an oncoming flow of a working gas passing through the turbine engine, and including a plurality of the flow directing members located adjacent to each other, wherein each platform includes an axially extending mateface located in facing relationship to a mateface of an adjoining flow directing member to form mateface gaps, and at least a portion of the outer groove end is circumferentially located adjacent to one of the mateface gaps for effecting a flow of cooling air toward a leading edge of an airfoil on the adjoining flow directing member.

4. The flow directing member of claim 3, comprising contours on the endwall including peaks adjacent to the leading edges of the airfoils and extending along at least a portion of the endwalls adjacent to suction sides of the airfoils, and including at least one valley located along at least a portion of the endwalls adjacent to pressure sides of the airfoils, wherein the outer groove end discharges cooling air to flow between the peaks at the leading edges of the airfoils and toward the at least one valley.

5. The flow directing member of claim 1, wherein the axial surface comprises a rearward axial surface facing axially rearwardly in a downstream direction of the working gas, and including a plurality of the flow directing members located adjacent to each other, wherein each platform includes an axially extending mateface located in facing relationship to a mateface of an adjoining flow directing member to form mateface gaps, and at least a portion of the outer groove end is circumferentially located adjacent to one of the mateface gaps for effecting a flow of cooling air toward a trailing edge of an airfoil on the adjoining flow directing member.

6. The flow directing member of claim 5, comprising contours on the endwall including valleys located adjacent to the junction and extending in a region between trailing edges of the airfoils and adjacent mateface gaps, and at least a portion of the outer groove end of the groove is circumferentially located adjacent to one of the mateface gaps for effecting a flow of cooling air toward a valley on an endwall of an adjoining flow directing member.

7. The flow directing member of claim 1, wherein an axial depth of the groove increases from a circumferential location corresponding to the location of the inner groove end toward a mateface of the platform.

8. The flow directing member of claim 1, wherein the axial surface is generally perpendicular to the endwall.

9. The flow directing member of claim 8, wherein the inner groove end is located adjacent to an angel wing seal member extending axially from the axial surface.

10. The flow directing member of claim 8, wherein the fluid flow directing feature comprises a single groove per airfoil provided on the platform, the groove extending more than one quarter of a circumferential length of the platform.

11. A flow directing member for a gas turbine engine, the flow directing member including a platform supported on a rotor and comprising a radially facing endwall, a forward axial surface facing axially forwardly toward an oncoming flow of a working gas and extending radially inwardly from a forward junction with the endwall, and a rearward axial surface facing axially rearwardly in a downstream direction of the working gas and extending radially inwardly from a rearward junction with the endwall, the flow directing member further including an airfoil extending radially outwardly from the endwall, the flow directing member further comprising:

a first groove defining a first fluid flow directing feature, the first groove extending axially into the forward axial surface and directing cooling fluid from a first cooling fluid cavity associated with the flow directing member;

a second groove defining a second fluid flow directing feature, the second groove extending axially into the rearward axial surface and directing cooling fluid from a second cooling fluid cavity associated with the flow directing member; and at least one contour on the endwall comprising at least one of:

at least one peak adjacent to a leading edge of the airfoil and extending along at least a portion of the endwall adjacent to a suction side of the airfoil; and at least one valley located along at least a portion of the endwall adjacent to a pressure side of the airfoil.

12. The flow directing member of claim 11, wherein:

the first groove comprises a radially inner groove end and a radially outer groove end, the outer groove end of the first groove defining an axially extending notch in the forward junction and forming an opening in the endwall for directing cooling fluid from the first cavity to the endwall; and the second groove including a radially inner groove end and a radially outer groove end, the outer groove end of the second groove defining an axially extending notch in the rearward junction and forming an opening in the endwall for directing cooling fluid from the second cavity to the endwall.

13. The flow directing member of claim 12, wherein the first and second grooves are each defined by respective first and second axially and radially extending groove walls that extend generally perpendicular to one another.

14. The flow directing member of claim 12, including a plurality of the flow directing members located adjacent to each other, wherein each platform includes an axially extending mateface located in facing relationship to a mateface of an adjoining flow directing member to form mateface gaps, and at least a portion of the outer groove end of the first groove is circumferentially located adjacent to one of the mateface gaps for effecting a flow of cooling air toward a leading edge of an airfoil on the adjoining flow directing member.

15. The flow directing member of claim 14, comprising contours on the endwall including peaks adjacent to the leading edges of the airfoils and extending along at least a portion of the endwalls adjacent to suction sides of the airfoils, and including at least one valley located along at least a portion of the endwalls adjacent to pressure sides of the airfoils, wherein the outer groove end of the first groove discharges cooling air to flow between the peaks at the leading edges of the airfoils and toward the at least one valley.

16. The flow directing member of claim 15, wherein the contours further include valleys located adjacent to the rearward junction and extending in a region between trailing edges of the airfoils and adjacent mateface gaps, and at least a portion of the outer groove end of the second groove is circumferentially located adjacent to one of the mateface gaps for effecting a flow of cooling air toward a valley on an endwall of an adjoining flow directing member.

17. The flow directing member of claim 12, wherein the cooling fluid directed by the first groove includes a component in a first direction that is parallel to a direction of rotation of the rotor, and the cooling fluid directed by the second groove includes a component in a second direction opposite to the first direction.

18. The flow directing member of claim 12, wherein the flow directing member comprises a single first groove per airfoil provided on the platform and a single second groove per airfoil provided on the platform, the first and second grooves each extending more than one quarter of a circumferential length of the platform.

* * * * *